US007622232B2

(12) United States Patent
Yokota et al.

(10) Patent No.: US 7,622,232 B2
(45) Date of Patent: Nov. 24, 2009

(54) ELECTROPHOTOGRAPHIC PHOTORECEPTOR AND ELECTROPHOTOGRAPHIC IMAGING APPARATUS EMPLOYING THE PHOTORECEPTOR

(75) Inventors: Saburo Yokota, Suwon-si (KR); Seung-ju Kim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 413 days.

(21) Appl. No.: 11/638,456

(22) Filed: Dec. 14, 2006

(65) Prior Publication Data

US 2007/0190439 A1 Aug. 16, 2007

(30) Foreign Application Priority Data

Feb. 16, 2006 (KR) ..... 10-2006-0015158

(51) Int. Cl.
*G03G 15/02* (2006.01)

(52) U.S. Cl. ..... 430/58.85; 430/59.5; 430/73; 430/74; 399/159

(58) Field of Classification Search ..... 430/58.85, 430/59.5, 73, 74; 399/159
See application file for complete search history.

(56) References Cited

U.S. PATENT DOCUMENTS

| | | | | |
|---|---|---|---|---|
| 3,873,312 | A | 3/1975 | Contois et al. | |
| 4,898,799 | A | 2/1990 | Fujimaki et al. | |
| 6,022,998 | A | 2/2000 | Kawaguchi et al. | |
| 6,090,514 | A | 7/2000 | Kakui et al. | |
| 6,432,595 | B1 | 8/2002 | Kawaguchi et al. | |
| 2004/0101771 | A1 * | 5/2004 | Azuma et al. | 430/58.85 |

FOREIGN PATENT DOCUMENTS

| | | |
|---|---|---|
| JP | 10-207093 | 8/1998 |
| JP | 2000-239236 | 9/2000 |
| KR | 2003-0097705 | 12/2003 |

* cited by examiner

*Primary Examiner*—Mark A Chapman
(74) *Attorney, Agent, or Firm*—Roylance, Abrams, Berdo & Goodman, L.L.P.

(57) ABSTRACT

An electrophotographic photoreceptor including a photosensitive layer which includes a titanyl phthalocyanine crystal having a major absorption peak at a wavelength of 780 nm±10 nm and a minor absorption peak having an intensity of ¾ or less of the major absorption peak at 690 nm±10 nm in the visible-infrared absorption spectrum and a distyryl compound having a predetermined structure. An electrophotographic image forming apparatus employing the electrophotographic photoreceptor is also provided. The electrophotographic photoreceptor and the electrophotographic image forming apparatus have good photosensitivity and charging properties and good stability over repeated charging obtained by using an optimum combination of a new crystal type of a highly photosensitive titanyl phthalocyanine and a distyryl compound which is a charge transporting material that is compatible with the titanyl phthalocyanine.

11 Claims, 3 Drawing Sheets

ELECTROPHOTOGRAPHIC PHOTORECEPTOR AND ELECTROPHOTOGRAPHIC IMAGING APPARATUS EMPLOYING THE PHOTORECEPTOR

CROSS-REFERENCE TO RELATED PATENT APPLICATION

This application claims the benefit of Korean Patent Application No. 10-2006-0015158, filed on Feb. 16, 2006 in the Korean Intellectual Property Office, the disclosure of which is hereby incorporated by reference in its entirety.

BACKGROUND OF THE INVENTION

1. Field of the Invention

The present invention relates to an electrophotographic photoreceptor and an electrophotographic image forming apparatus, and more particularly, to an electrophotographic photoreceptor having high photosensitivity and good stability over repeated charging. The invention is also directed to an image forming apparatus employing the electrophotographic photoreceptor.

2. Description of the Related Art

Phthalocyanine compounds show good photoconductivity to light in the range of visible light to near infrared and thus are widely used as a photoelectric material for a charge generating material of electrophotographic photoreceptors or organic solar batteries. Titanyl phthalocyanine compounds having a tetravalent titanium atom bonded with a hydrogen molecule as a main metal are used mostly for their good photosensitivity and stability.

Like many other phthalocyanine compounds, titanyl phthalocyanine compounds have various crystal forms at room temperature.

For example, U.S. Pat. No. 4,664,997 discloses a titanyl phthalocyanine crystal having a major absorption peak at a wavelength of around 760 nm. This crystal type is generally known as a β-type and has the most stability and the lowest photosensitivity among currently used titanyl phthalocyanine crystals.

U.S. Pat. No. 4,728,592 discloses an α-type titanyl phthalocyanine crystal having a major absorption peak at a wavelength of around 830 nm. The photosensitivity of the α-type titanyl phthalocyanine crystal is 1.5 times greater than that of the β-type titanyl phthalocyanine crystal, which is effective for obtaining a high efficiency electrophotographic photoreceptor.

U.S. Pat. No. 4,898,799 discloses a phthalocyanine crystal type having a major absorption peak at a Bragg angle (2θ) of 27.3° in an X-ray diffraction spectrum. This crystal type is generally called a Y-type or γ-type, and has high quantum efficiency of 90% or more at the intensity of an ordinary electrical field and is practically utilized for a super high photosensitivity photoreceptor. The Y-type crystal shows a plurality of major absorption peaks in a long wavelength range, and has generally an absorption peak at a wavelength of around 800 nm and around 850 nm, and their intensity ratio can vary according to manufacturing conditions. This crystal type is quasi-stable, and is likely to be stabilized by being exposed to heat or a mechanical stress, or contact with a solvent, thereby reducing the photosensitivity. Also, this crystal type is known to include water molecules in the crystal structure and thus its property varies according to the humidity of the environment.

Also, U.S. Pat. No. 5,252,417 discloses a titanyl phthalocyanine crystal obtained from an amorphous titanyl phthalocyanine treated with monochlorobenzene and water. The titanyl phthalocyanine crystal has a major absorption peak at a Bragg angle (2θ) of about 27.3° in an X-ray diffraction spectrum like a Y-type titanyl phthalocyanine crystal, but shows a different visible-infrared absorption spectrum, and thus has a major absorption peak at a wavelength of around 790 nm and a minor absorption peak at around 710 nm.

However, when such highly sensitive titanyl phthalocyanine charge generating materials are used, the sensitivity of the photoreceptor may increase, but this increase may not be sufficient and a charge transporting material to be used in combination with the titanyl phthalocyanine charge generating material should be selected appropriately. When the combination of the charge generating material and the charge transporting material is not appropriate, the highly photosensitive titanyl phthalocyanine charge generating material cannot properly fulfill its function, and thus even when a highly photosensitive titanyl phthalocyanine charge generating material is used, the photosensitivity of the electrophotographic photoreceptor manufactured using the charge generating material is not sufficient and/or the stability over repeated charging of the photoreceptor may rapidly decrease.

SUMMARY OF THE INVENTION

The present invention provides an electrophotographic photoreceptor having good photosensitivity and repetition stability by appropriately using a highly photosensitive titanyl phthalocyanine having new crystal forms.

The present invention also provides an electrophotographic image forming apparatus employing the electrophotographic photoreceptor.

According to an aspect of the present invention, an electrophotographic photoreceptor is provided comprising:

an electrically conductive substrate; and a photosensitive layer formed on the electrically conductive substrate, wherein the photosensitive layer comprises a titanyl phthalocyanine crystal having a major absorption peak at a wavelength of 780 nm±10 nm and a minor absorption peak having an intensity of ¾ or less of the major absorption peak at 690 nm±10 nm in the visible-infrared absorption spectrum and a distyryl compound represented by Formula 1 below:

[Formula 1]

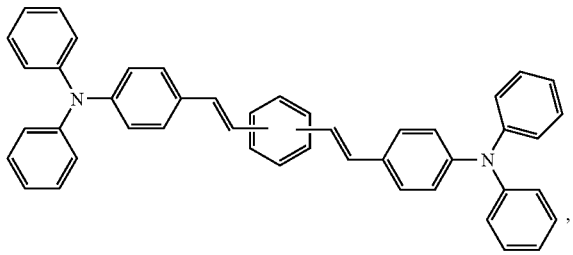

where at least one hydrogen atom of the phenyl and the phenylene group can be substituted with a $C_1$-$C_6$ alkyl group or a $C_1$-$C_6$ alkoxy group.

According to another aspect of the present invention, an electrophotographic image forming apparatus is provided comprising:

an electrophotographic photoreceptor comprising: an electrically conductive substrate; and a photosensitive layer formed on the electrically conductive substrate, wherein the photosensitive layer comprises a titanyl phthalocyanine crystal having a major absorption peak at a wavelength of 780 nm±10 nm and a minor absorption peak having an intensity of ¾ or less of the major absorption peak at 690 nm±10 nm in the visible-infrared absorption spectrum, and a distyryl compound represented by Formula 1 below:

[Formula 1]

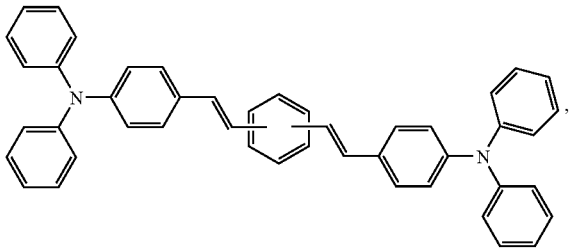

where at least one hydrogen atom of the phenyl and the phenylene group can be substituted with a $C_1$-$C_6$ alkyl group or a $C_1$-$C_6$ alkoxy group;

a charging apparatus for charging the electrophotographic photoreceptor;

an imagewise light irradiating device for irradiating imagewise light to the charged electrophotographic photoreceptor in order to form an electrostatic latent image on the electrophotographic photoreceptor;

a developing unit for developing the electrostatic latent image with toner in order to form a toner image on the electrophotographic photoreceptor; and a transfer unit for transferring the toner image to an image receptor.

The electrophotographic photoreceptor and the electrophotographic image forming apparatus according to the present invention can show good electrostatic characteristics such as good photosensitivity and stability over repeated charging by using the optimum combination of a highly photosensitive titanyl phthalocyanine having a new crystal type and a charge transporting material that is compatible with the titanyl phthalocyanine.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
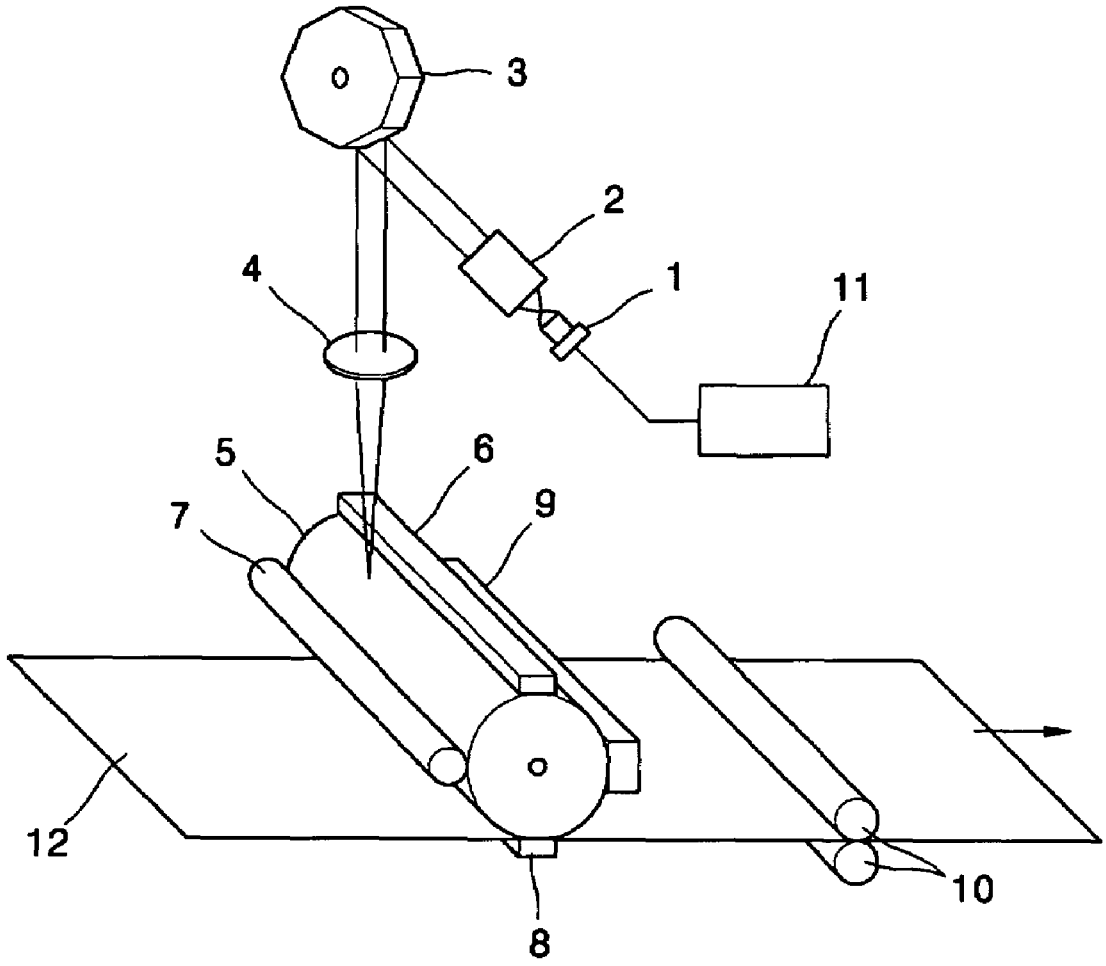
FIG. 1 is a schematic view of an electrophotographic image forming apparatus employing an electrophotographic photoreceptor according to an embodiment of the present invention.

The present invention will now be described more fully with reference to the accompanying drawings, in which exemplary embodiments of the invention are shown.

An electrophotographic photoreceptor according to an embodiment of the present invention comprises an electrically conductive substrate and a photosensitive layer formed on the electrically conductive substrate, wherein the photosensitive layer comprises a titanyl phthalocyanine crystal having a major absorption peak at a wavelength of 780 nm±10 nm and a minor absorption peak having an intensity of ¾ or less of the major absorption peak at 690 nm±10 nm in the visible-infrared absorption spectrum as a charge generating material, and a distyryl compound represented by Formula 1 below as a charge transporting material:

[Formula 1]

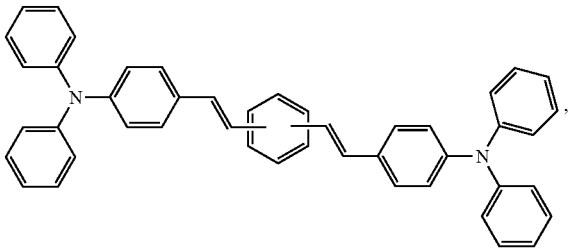

where at least one hydrogen atom of the phenyl and the phenylene group can be substituted with a $C_1$-$C_6$ alkyl group or a $C_1$-$C_6$ alkoxy group.

In other words, the electrophotographic photoreceptor according to the current embodiment of the present invention includes a photosensitive layer formed on the electrically conductive substrate, wherein the photosensitive layer includes a titanyl phthalocyanine crystal with the above described characteristics as a charge generating material and a distyryl compound represented by Formula 1 above as a charge transporting material.

The visible-infrared absorption spectrum pattern of the titanyl phthalocyanine crystal used as the charge generating material in the present invention is remarkably different from that of a conventional titanyl phthalocyanine crystal. That is, a conventional highly photosensitive titanyl phthalocyanine crystal except a β-type titanyl phthalocyanine crystal having a low sensitivity has a major absorption peak at a wavelength of 800 nm or greater. However, the titanyl phthalocyanine crystal used in the current embodiment of the present invention has a major absorption peak at a wavelength of about 780 nm±10 nm, and a minor absorption peak having an intensity of ¾ or less of the major absorption peak at 690 nm±10 nm. The lowest value for the intensity of the minor absorption peak is not limited as long as it can be recognized as an individual peak. Also, the titanyl phthalocyanine crystal in the current embodiment of the present invention substantially does not have an independent absorption peak at a wavelength of 800 nm or greater.

The titanyl phthalocyanine crystal used in the current embodiment of the present invention shows an X-ray diffraction spectrum that is remarkably different from that of a conventional titanyl phthalocyanine crystal. That is, the titanyl phthalocyanine crystal used in the current embodiment of the present invention shows a distinct peak at a Bragg angle (2θ) of 9.2°, 14.5°, 18.1°, 24.1°, and 27.3° (all including an error of ±0.2°). Many of these peaks may also be observed in a Y-type phthalocyanine crystal. But, the titanyl phthalocyanine crystal used in the current embodiment of the present invention does not have other various peaks such as those observed at 9.6°, 11.7°, and 15.0° (all including an error of ±0.2°). This difference indicates that the titanyl phthalocyanine crystal used in the current embodiment of the present invention has a similar lattice constant as the Y-type titanyl phthalocyanine crystal but has a different lattice symmetry.

Comparing the titanyl phthalocyanine crystal disclosed in U.S. Pat. No. 5,252,417 and the titanyl phthalocyanine crystal used in the current embodiment of the present invention, both are similar in that they do not have an absorption peak at a wavelength of 800 nm or greater in a visible-infrared absorption spectrum, but are different in that the position of the X-ray diffraction peak, the positions of the visible-infrared absorption spectrum peaks, and their intensity distribution are not the same. For example, the X-ray diffraction spectrum of the titanyl phthalocyanine crystal disclosed in U.S. Pat. No. 5,252,417 does not have a diffraction peak at a Bragg angle of 9.2°.

As described above, the titanyl phthalocyanine crystal used in the current embodiment of the present invention is considerably different from the titanyl phthalocyanine crystal disclosed in the above disclosed publications in terms of the shape of the visible-infrared absorption spectrum and the X-ray diffraction spectrum.

Hereinafter, a method of manufacturing the titanyl phthalocyanine crystal used in the current embodiment of the present invention will be described.

The titanyl phthalocyanine crystal used in the current embodiment of the present invention can be obtained by kneading a titanyl phthalocyanine crystal having an absorption peak at a wavelength of 800 nm in a visible-infrared absorption spectrum using an alcoholic solvent. In other words, the titanyl phthalocyanine crystal used in the current embodiment of present invention is obtained using a quasi-stable titanyl phthalocyanine crystal having an absorption peak at a wavelength of 800 nm such as an amorphous type (quasi α-type) or Y type (γ type) titanyl phthalocyanine which may be treated with an acid-paste as a raw material. When the quasi-stable titanyl phthalocyanine is kneaded with an alcoholic solvent and, if necessary, with a binding resin, the titanyl phthalocyanine crystal used in the current embodiment of the present invention having the above described properties can be obtained. The titanyl phthalocyanine crystal is kneaded in the presence of a lower aliphatic alcohol under shear stress that is sufficient to convert or modify the amorphous titanyl phthalocyanine crystals to the modified lattice structure of the invention.

Examples of the alcoholic solvent that can be used for crystal conversion include a $C_1$-$C_9$ aliphatic lower alcohol. Among these alcohols, methanol, ethanol, propanol, butanol, etc. are preferable due to their ease of handling. The lower alcoholic solvent can be used alone or in combination of at least two. Also, the alcoholic solvent can be used in combination with other organic solvents and/or water within an allowable amount that does not harm the effect of the present invention. For example, a mixture of an alcoholic solvent and water can be used in the mixture ratio of an alcoholic solvent/water=99/1–10/90, preferably 99/1–40/60.

The amount of the solvent to be used may be 1-100 times the weight of titanyl phthalocyanine, preferably 2-10 times. The amount of the binding resin may be 0.1-100 times the weight of the titanyl phthalocyanine, preferably 0.2-5 times, and more preferably 0.3-5 times.

Kneading can be performed using an apparatus that can generate a high shear stress while kneading such as a kneader, a 2 roll-mill, a 3 roll-mill, and a Banbury mixer, and the like. Such an apparatus can be used alone or in a combination of at least two. On the other hand, when a sand mill, a ball mill, or an attritor, or the like is used, it is difficult to provide sufficient shear stress for crystal conversion to obtain a highly photosensitive titanyl phthalocyanine crystal used in the current embodiment of the present invention, and thus, such an apparatus cannot be substantially used for crystal conversion in the present invention.

Also, heating to an appropriate temperature during kneading is effective for crystal conversion. For example, kneading can be performed at a temperature in a range of room temperature to about 200° C., preferably about 50-150° C., in consideration of the glass transition temperature of a binding resin. When a binding resin is used in combination, a solid dispersion obtained by finely pulverizing the kneaded mixture can be directly used for the manufacture of a composition (pigment) for forming a photosensitive layer, and thus a filtering step or a washing step using alcohol or water which is used in a conventional crystal conversion method can be omitted.

The titanyl phthalocyanine obtained as above has high photosensitivity similar to Y-type crystal. The average diameter of the titanyl phthalocyanine particles is fine and uniform due to kneading. Accordingly, the titanyl phthalocyanine crystal used in the current embodiment of the present invention has good dispersion stability and thus in a stable state due to the above conversion treatment, and thus is considerably more stable to heat and solvents than Y-type crystal.

The electrophotographic photoreceptor according to the current embodiment of the present invention includes a distyryl compound represented by Formula 1 as a charge transporting material. The distyryl compound is disclosed in U.S. Pat. No. 3,873,312, and is expected to have good hole transporting ability, but the compatibility with a charge generating material used in combination with the distyryl compound may change the property of the distyryl compound, and thus may cause high residual potential or bad stability over repeated charging. Factors that determine an optimum combination of the distyryl compound and the charge generating material are typically explained by energy levels of these materials; however, a predicted result cannot be always obtained. Accordingly, an optimum combination of the distyryl compound and the charge generating material can only be obtained from combination experiments of various materials using trial and error method. The inventors have discovered that the combination of the highly photosensitive titanyl phthalocyanine crystal having the above described properties as a charge generating material and the distyryl compound of Formula 1 as a charge transporting material produces high photosensitivity and stability over repeated charging, enabling it to obtain a highly useful electrophotographic photoreceptor to complete the present invention.

Meanwhile, other known charge generating materials can be used with the above titanyl phthalocyanine crystal within an allowable amount that does not harm the effect of the present invention. Examples of the known charge generating material that can be used in combination with the titanyl phthalocyanine crystal of the present invention include organic materials such as phthalocyanine pigment other than the above titanyl phthalocyanine crystal, azo-based pigment, quinone-based pigment, perylene-based pigment, indigo-based pigment, bisbenzoimidazole-based pigment, quinacridone-based pigment, azulenium-based pigment, squarylium-based pigment, pyrylium-based pigment, triarylmethanebased pigment, cyanine-based pigment, and the like, or inorganic materials such as amorphous silicon, amorphous selenium, trigonal selenium, telulium, selenium-telulium alloy, cadmium sulfide, antimony sulfide, zinc sulfide, and the like.

The electrophotographic photoreceptor according to the current embodiment of the present invention includes a distyryl compound represented by Formula 1:

[Formula 1]

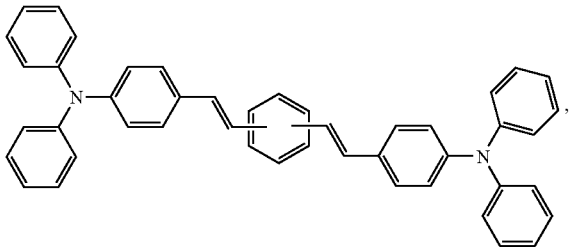

or a compound of Formula 1 where at least one hydrogen atom of the phenyl and the phenylene group can be substituted with a $C_1$-$C_6$ alkyl group or a $C_1$-$C_6$ alkoxy group.

The distyryl compound represented by Formula 1 and a method of synthesizing the same is disclosed in Japanese Patent Laid-Open Gazette No. 2000-239236 and in Japanese Patent Laid-Open Gazette No. Hei 10-207093, and the disclosed contents thereof are incorporated herein by reference in their entirety.

Examples of the alkyl group include a methyl group, an ethyl group, an isopropyl group, an n-propyl group, an isobutyl group, and others, but are not limited thereto. Examples of the alkoxy group include a methoxy group, an ethoxy group, an n-propoxy group, an iso-propoxy group, an n-butoxy group, an iso-butoxy group, and others, but are not limited thereto.

Examples of the distyryl compound represented by Formula 1 include one of Compounds 1 through 6, but are not limited thereto.

Compound 1

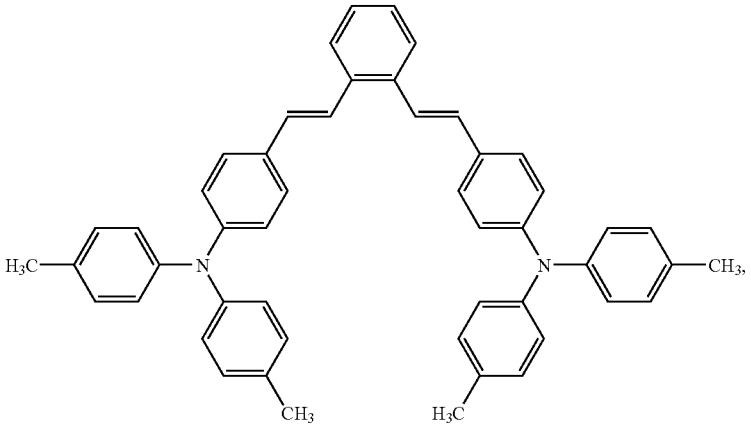

Compound 2

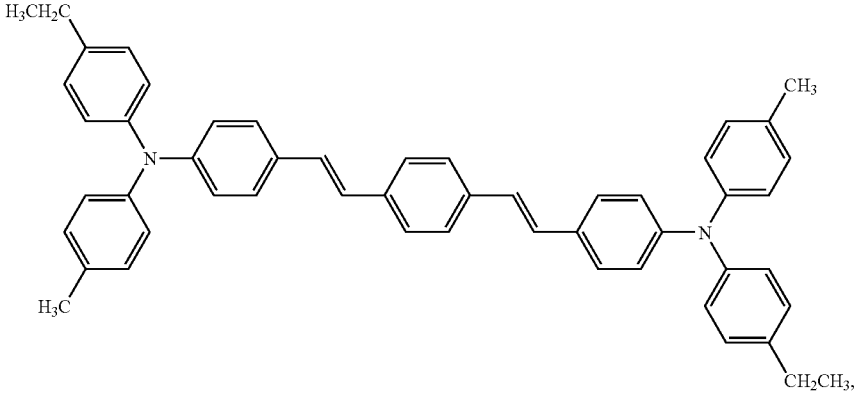

-continued
Compound 3
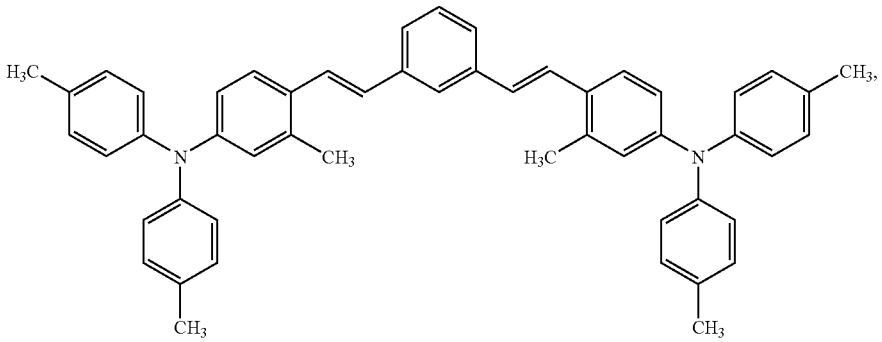
Compound 4
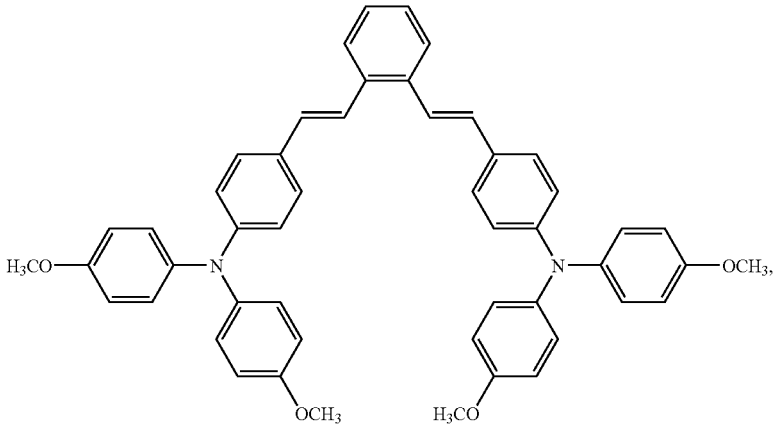
Compound 5
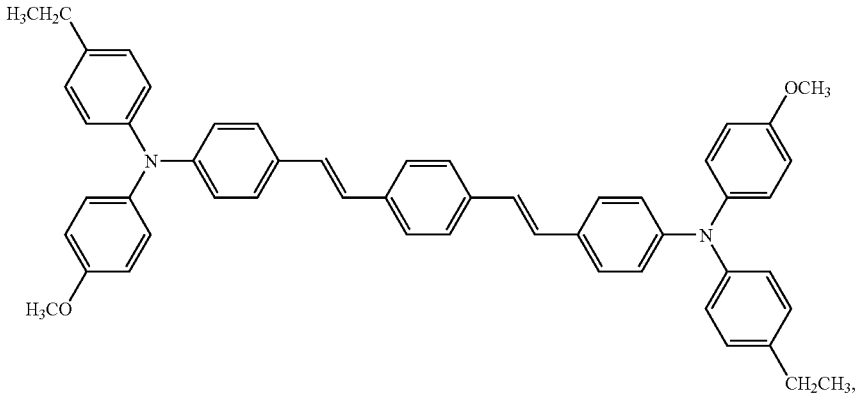
Compound 6
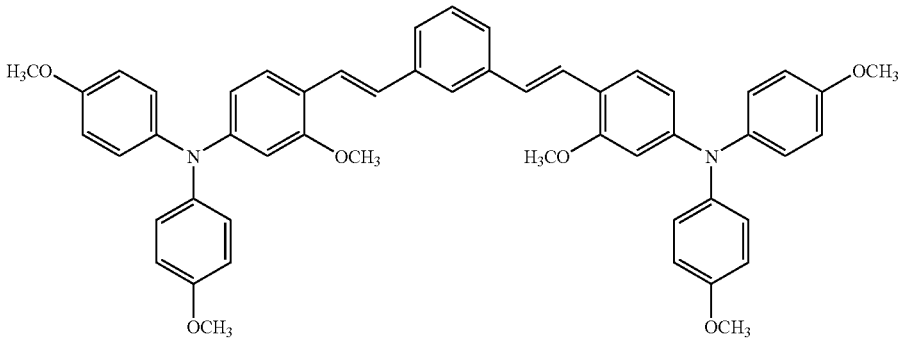

Also, other known hole transporting material and/or electron transporting material can be used with the distyryl compound represented by Formula 1 within an allowable amount that does not harm the effect of the present invention.

In various embodiments of the invention, the distyryl compound of Formula 1 can be unsubstituted or substituted with one or more $C_1$-$C_6$ alkyl or $C_{1-6}$ alkoxyl groups. Typically, the substituents are provided so that the compound of Formula 1 is symmetrical. In this respect, the number of substituents on the compound of Formula 1 is an even number. In one embodiment, the compound of Formula 1 is symmetrically substituted, and the number of substituents can range from 2-8 and typically 2-6.

Examples of the known hole transporting material that can be combined with the distyryl compound of Formula 1 include low molecular compounds such as a nitrogen-containing cyclic compound or a fused polycyclic compound such as pyrene-based, carbazole-based, hydrazone-based, oxazole-based, pyrazoline-based, arylamine-based, arylmethane-based, benzidine-based, thiazole-based, stylbene-based, and butadiene-based compound, etc. Also, a high molecular weight compound or a polysilane compound having a functional group of the above low molecular compounds in a main chain or a side chain can be used. Examples of the high molecular weight compound include poly-N-vinyl carbazole, halogenized poly-N-vinyl carbazole, polyvinyl pyrene, polyvinyl anthracene, polyvinyl acridine, pyrene formaldehyde resin, ethyl carbazole formaldehyde resin, and triphenylmethane polymer, and the like.

Examples of the electron transporting material include electron withdrawing low molecular compounds such as benzoquinone-based, tetracyanoethylene-based, tetracyanoquinodimethane-based, fluorenone-based, xanthone-based, phenanthraquinone-based, phthalic anhydride-based, diphenoquinone-based, stilbene quinone-based, naphthalene-based, and thiopyrane-based, and others. A polymer compound having electron transporting ability or a pigment having electron transporting ability can also be used.

The hole transporting material or the electron transporting material that can be used with the electrophotographic photoreceptor according to the current embodiment of the present invention is not limited to the examples above. The material can be used alone or in combination of at least two.

The electrically conductive substrate can be made of any material having an electrical conductivity and may be in the form of a plate, a disk, a sheet, a belt, or a drum or the like made of a metal or a conductive polymer. Examples of the metal include aluminum, vanadium, nickel, copper, zinc, palladium, indium, tin, platinum, stainless steel, and chromium. Examples of the conductive polymer include polyester resin, polycarbonate resin, polyamide resin, polyimide resin, a mixture of these, and a copolymer of monomers which are used to synthesize the resins having conductive materials like a conductive carbon, zinc oxide, indium oxide or the like dispersed in it. A metal sheet or an organic polymer sheet on which metal is deposited or laminated may be also used as the electrically conductive substrate.

The photosensitive layer may be a laminated type where a charge generating layer and a charge transporting layer are separately formed or a single-layered type in which one layer has both a charge generating function and a charge transporting function. In a laminated type photosensitive layer, the titanyl phthalocyanine crystal is included in the charge generating layer and the distyryl compound is included in the charge transporting layer. In a single-layered type photosensitive layer, the titanyl phthalocyanine crystal and the distyryl compound are included in one photosensitive layer.

In a laminated type photosensitive layer, the charge generating material is dispersed with a binding resin in a solvent and a layer is formed by dip coating, ring coating, roll coating, spray coating, or the like to form a charge generating layer. The charge generating layer may also be formed using vacuum deposition, sputtering, chemical vapor deposition (CVD), or the like The thickness of the charge generating layer may be generally in the range of about 0.1-about 1 μm. When the thickness of the charge generating layer is less than 0.1 μm, the photosensitivity may not be sufficient, and when the thickness is greater than 1 μm, the charge ability and photosensitivity may decrease.

In the laminated type photosensitive layer, a charge transporting layer is formed on the charge generating layer. However, the charge generating layer may be formed on the charge transporting layer instead. In order to form a charge transporting layer, a solution in which a hole transporting material and a binding resin are dissolved in a solvent may be used for coating. The coating method may be dip coating, ring coating, roll coating, or spray coating like in the case of the charge generating layer. The thickness of the charge transporting layer may be generally 5 to 50 μm. If the thickness is less than 5 μm, the charging ability is not good, and if the thickness is greater than 50 μm, response speed and image quality decrease. The total thickness of the charge generating layer and the charge transporting layer are generally within the range from 5 to 50 μm.

The amount of binding resin in the charge generating layer may be about 5 to 350 parts by weight based on 100 parts by weight of the charge generating material including the highly photosensitive titanyl phthalocyanine crystal, preferably about 10 to 200 parts by weight. If the amount is less than 5 parts by weight, the dispersion of the titanyl phthalocyanine crystal in the present embodiment is not sufficient and thus it is difficult to obtain a uniform charge generating layer, and the adhesive force may also be degraded. If the amount is greater than 350 parts by weight, the charge potential is difficult to maintain and image quality decreases due to a reduced sensitivity.

In the charge transporting layer, the amount of the charge transporting material including a charge transporting material and/or a hole transporting material may be about 10 to 60% by weight of the total weight of the charge transporting layer. If the amount of the charge transporting layer is less than 10% by weight, the charge transporting ability is not sufficient and thus the residual potential is likely to increase. If the amount is over 60% by weight, the amount of the resin in the charge transporting layer decreases and the mechanical intensity decreases.

In the case of a single-layered type photosensitive layer, a photosensitive layer is obtained by dispersing a charge generating material including the titanyl phthalocyanine crystal according to the present invention in a solvent together with a binding resin and a charge transporting material including a distyryl compound represented by Formula 1 and coating the dispersion. The thickness of the single-layered type photosensitive layer may be generally about 5 to 50 μm.

Examples of the charge transporting material are a hole transporting material and an electron transporting material, however, the hole transporting material and the electron transporting material may be preferably used in combination, particularly, in the case of the single-layer type photosensitive layer. Since the single-layer type photosensitive layer uses a photosensitive layer in which a charge transporting material is dispersed with a charge generating material and a binding resin, charges are generated inside the photosensitive layer.

Thus, the photosensitive layer may preferably be capable of transporting both holes and electrons.

The binding resin may be a polymer which can form an electrically insulating film. Examples of the polymer include, but are not limited to, polycarbonate, polyester, methacrylic resin, acrylic resin, polyvinyl chloride, polyvinylidene chloride, polystyrene, polyvinylacetate, styrene-butadiene copolymer, vinylidene chloride-acrylonitrile copolymer, vinyl chloride-vinyl acetate copolymer, vinyl chloride-vinyl acetate-maleic anhydride copolymer, silicon resin, silicon-alkyd resin, phenol-formaldehyde resin, styrene-alkyd resin, poly-N-vinyl carbazole, polyvinyl butyral, polyvinyl formal, polysulfone, casein, gelatin, polyvinyl alcohol, ethyl cellulose, phenol resin, polyamide, carboxymethyl cellulose, vinylidene chloride-based polymer latex, polyurethane, and others. The binding resin may be used alone or in a combination of two or more.

The amount of charge transporting material including an electron transporting material and/or a hole transporting material in the single-layered type photosensitive layer may be about 10 to 60% by weight based on the total weight of the photosensitive layer. If the amount is less than 10% by weight, the charge transporting ability is not sufficient, and thus the sensitivity is not sufficient and the residual potential is likely to increase. If the amount is over 60% by weight, the amount of resin in the photosensitive layer decreases, and thus, the mechanical strength is likely to decrease.

Regardless of whether a photosensitive layer is a laminated type or single-layered type, the electrophotographic photoreceptor may include additives such as a plasticizer, a surface modifier, a dispersion stabilizer, an antioxidant, a photostabilizer, and the like, in the photosensitive layer together with the binding resin.

Examples of the plasticizer include, but are not limited to, biphenyl, chlorinated biphenyl, terphenyl, dibutyl phthalate, diethylene glycol phthalate, dioctyl phthalate, triphenyl phosphate, methyl naphthalene, benzophenone, a chlorinated paraffin, polypropylene, polystyrene, and a fluorinated hydrocarbon.

Examples of the surface modifier include silicone oil, fluorine resin, and the like, but are not limited thereto.

Also, a deterioration inhibitor such as oxidization inhibitor or photostabilizer may be included in the photosensitive layer used in the current embodiment of the present invention in order to improve resistance to environmental conditions or stability against harmful light. Examples of the deterioration inhibitor include, but are not limited to, chromanol derivatives such as tocopherol and its etherified derivatives or esterified derivatives, a polyaryl alkane compound, and a hydroquinone derivative and its mono- and dietherified derivatives, a benzophenone derivative, a benzotriazole derivative, an sulfided ether compound, a phenylenediamine derivative, phosphonic acid ester, phosphite ester, a phenolic compound, a sterically hindered phenolic compound, a straight-chain amine compound, a cyclic amine compound, and a sterically hindered amine compound.

In the electrophotographic photoreceptor according to an embodiment of the present invention, an intermediate layer may be further interposed between the electrically conductive substrate and the photosensitive layer in order to improve adhesive force or prevent charge injection from the electrically conductive substrate. Examples of the intermediate layer include, but are not limited to, an anodic oxide layer of aluminum (alumite layer), a resin dispersion layer of metal oxide powder such as titanium oxide, tin oxide, and the like, and resin layers like polyvinyl alcohol, casein, ethyl cellulose, gelatin, phenol resin, polyamide, and the like. The thickness of the intermediate layer may be preferably in the range of about 0.05 to 5 μm.

Also, the electrophotographic photoreceptor according to an embodiment of the present invention may further include a surface protection layer if necessary.

When the photosensitive layer is formed using a dip coating method, the above described amount of charge generating material and/or charge transporting material with a binding resin is dissolved or dispersed in a solvent in order to be used as a composition for forming the photosensitive layer. The solvent which dissolves the binder resin may vary depending on the type of binding resin. Examples of the organic solvent include alcohols such as methanol, ethanol, n-propanol, isopropanol, 1-butanol, 2-butanol, 1-methoxy-2-propanol, and others; ketones such as acetone, methyl ethyl ketone, cyclohexanone, methyl isopropyl ketone, methyl isobutyl ketone, 4-methoxy-4methyl-2-penthanone, and the like; amides such as N,N-dimethylformamide, N,N-dimethyl acetamide, etc.; ethers like tetrahydrofurane, dioxane, methyl cellosolve, and the like; esters such as methyl acetate, ethyl acetate, isopropyl acetate, t-butyl acetate, and the like; sulfoxides such as dimethyl sulfoxide, and the like; aliphatic halogenated hydrocarbons such as 1,2-dichloroethane, 1,1,2-tricholoroethane, 1,1,1-tricholoroethane, trichloroethylene, tetracholoroethane, dichloromethane, methylene chloride, chloroform, carbon tetrachloride, tricholoroethane, and the like; aromatics such as benzene, toluene, ethyl benzene, xylene, monochlorobenzene, dichlorobenzene, and the like; and amines such as butyl amine, diethyl amine, ethylene diamine, isopropanol amine, triethanol amine, triethylene diamine, and the like. Regardless of whether the photosensitive layer is a laminated type or single-layered type, a solvent which does not affect adjacent layers should preferably be selected.

The electrophotographic photoreceptor according to an embodiment of the present invention can be integrated in an electrophotographic image forming apparatus such as a laser printer, a photocopier, a fax machine, a LED printer, or the like According to another embodiment of the present invention, an electrophotographic image forming apparatus is provided comprising an electrophotographic photoreceptor comprising an electrically conductive substrate; and a photosensitive layer formed on the electrically conductive substrate, wherein the photosensitive layer has a major absorption peak at a wavelength of 780 nm±10 nm in the visible-infrared absorption spectrum, and a titanyl phthalocyanine crystal having a minor absorption peak having an intensity of ¾ or less of the major absorption peak at 690 nm±10 nm is included as a charge generating material, and a distyryl compound represented by Formula 1 below is included as a charge transporting material; a charging unit charging the electrophotographic photoreceptor; a imagewise light radiation unit radiating the charged electrophotographic photoreceptor to form an electrostatic latent image on the electrophotographic photoreceptor with imagewise light; a developing unit developing the electrostatic latent image with toner to form a toner image on the electrophotographic photoreceptor; and a transferring unit transferring the toner image to the image receptor. In other words, the electrophotographic image forming apparatus according to the current embodiment of the present invention comprises an electrophotographic photoreceptor according to an embodiment of the present invention.

FIG. 1 schematically illustrates an electrophotographic image forming apparatus according to an embodiment of the present invention. Referring to FIG. 1, reference numeral 1 refers to a semiconductor laser. Laser light that is signalmodulated by a control circuit 11 according to image information, after being radiated is collimated by an optical correction system 2 and performs scanning while being reflected by a polygonal rotatory mirror 3. The laser light is focused on a surface of an electrophotographic photoreceptor 5 by a scanning lens 4 and exposes the surface according to the image information. Since the electrophotographic photoreceptor is already charged by a charging apparatus 6, an electrostatic latent image is formed by the exposure, and then becomes visible by a developing apparatus 7. The visible image is transferred to an image receptor 12 such as paper by a transferring apparatus 8, and is fixed in a fixing apparatus 10 and provided as a print result. The electrophotographic photoreceptor can be used repeatedly by removing coloring agent that remains on the surface thereof by a cleaning apparatus 9. The electrophotographic photoreceptor here is drawn in the form of a drum; however, as described above, it may also be in the form of a sheet or a belt.

Hereinafter, the present invention will be described in detail with reference to the following examples. However, these examples are for illustrative purposes only and are not intended to limit the scope of the invention. "Part" described in the present invention refers to "parts by weight".

MANUFACTURING EXAMPLE 1

2 parts of Y-type titanyl phthalocyanine which is synthesized according to the method disclosed in U.S. Pat. No. 4,898,799 and 1 part of polyvinyl butyral resin ("S-LEC BM-1", available from Sekisui Chemical Co., Ltd.) were mixed with 5 parts of isopropyl alcohol and kneaded using a two-roll mill (R2-type available from Kodaira Seisakusho Co., Ltd). The obtained dispersion was dried in an oven at 100° C. for 1 hour and crushed to obtain a solid dispersion with a chip-like shape.

Figure 2:
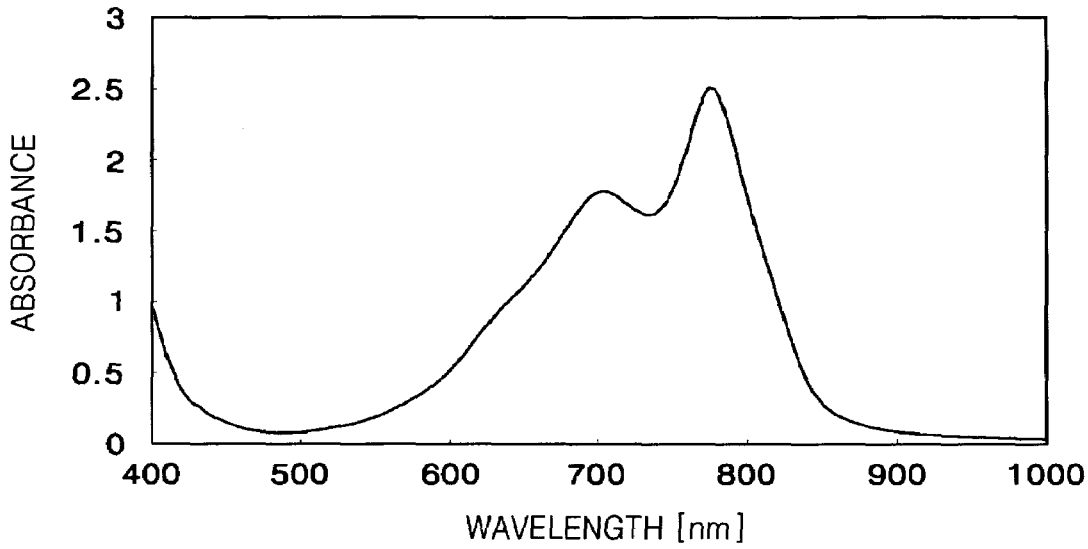
FIG. 2 illustrates a visible-infrared absorption spectrum of a titanyl phthalocyanine crystal obtained in Manufacturing Example 1.
Figure 3:
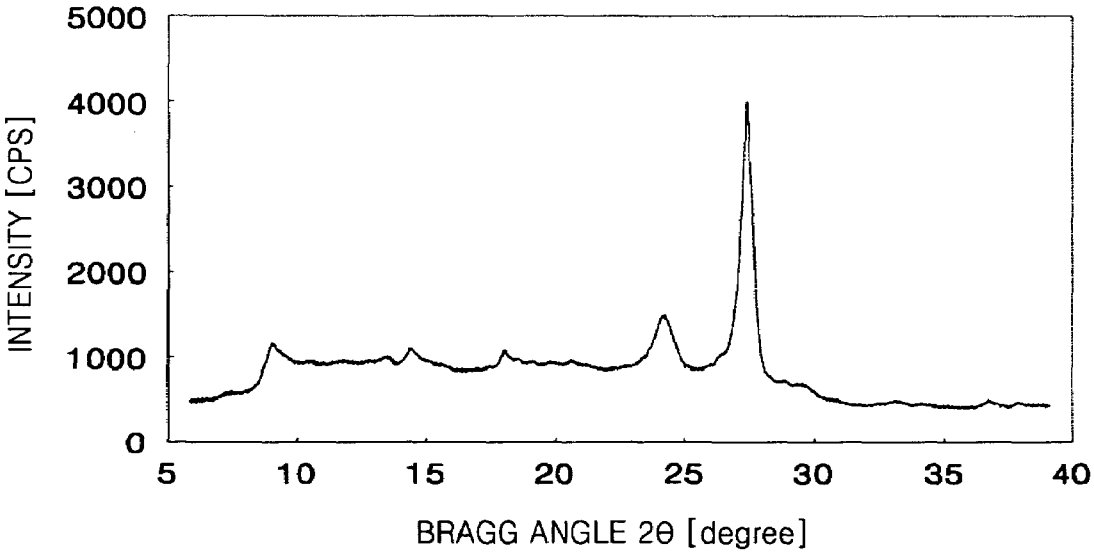
FIG. 3 illustrates an X-ray diffraction spectrum of a titanyl phthalocyanine obtained in Manufacturing Example 1.

FIGS. 2 and 3 respectively illustrate the visible-infrared absorption spectrum and the X-ray diffraction spectrum of the present sample (using Cu Kαline). The absorption spectrum of FIG. 2 is obtained using a dilute dispersion sample in which the solid dispersion is dispersed in ethanol, and the X-ray spectrum of FIG. 3 is obtained by radiating Cu Kα line to the solid dispersion sample.

Referring to FIG. 2, the titanyl phthalocyanine crystal has a major absorption peak at a wavelength of around 780 nm in the visible-infrared absorption spectrum, and a minor absorption peak which has about 70% of the intensity of the major absorption peak at around 700 nm. Also, the titanyl phthalocyanine crystal does not have an absorption peak at a wavelength of 800 nm or greater.

Referring to the X-ray diffraction spectrum of FIG. 3, the titanyl phthalocyanine crystal shows a distinct diffraction peak at a Bragg angle (2θ) at about 9.2°, about 14.5°, about 18.1°, about 24.1°, and about 27.3°.

EXAMPLE 1

A coating composition obtained by dissolving 4 parts of the solid dispersion obtained from Manufacturing Example 1 with 96 parts of ethanol was coated using a ring coating method on an anodized aluminum drum having a diameter of 30 mm and dried to form a charge generating layer to a thickness of about 0.4 μm. Then a solution in which 60 parts of polycarbonate resin Z ("lupilon Z-200", available from Mitsubishi Gas Chemical) and 40 parts of distyryl Compound 1 below were dissolved in 300 parts of chloroform was coated thereon and was dried at 100° C. for 1 hour to form a charge transporting layer to a thickness of about 20 μm to obtain a laminated type electrophotographic photoreceptor.

Compound 1

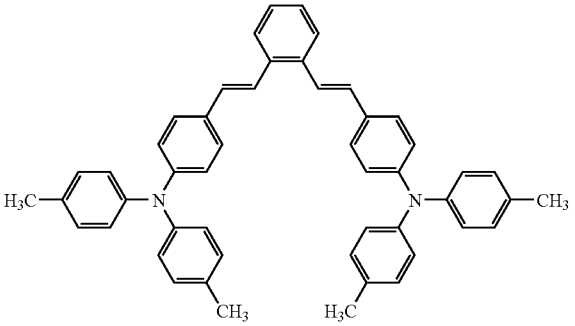

EXAMPLE 2

A laminated type electrophotographic photoreceptor was obtained in the same manner as in Example 1 except that distyryl Compound 2 below was used instead of distyryl Compound 1.

Compound 2

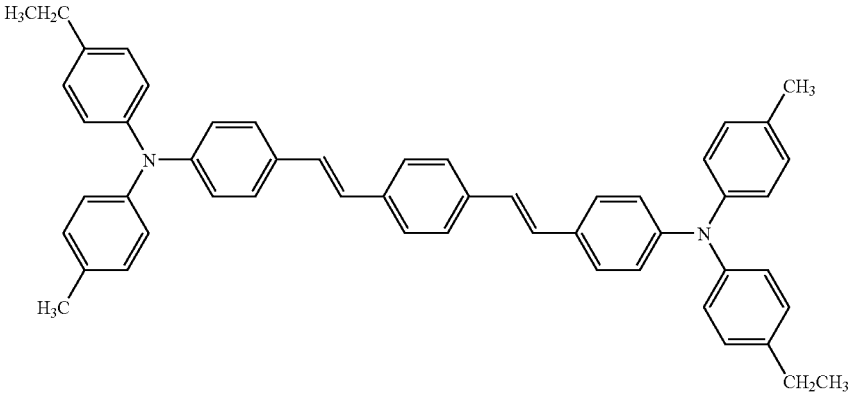

EXAMPLE 3

A laminated type electrophotographic photoreceptor was obtained in the same manner as Example 1 except that distyryl Compound 3 below was used instead of distyryl Compound 1.

Compound 3

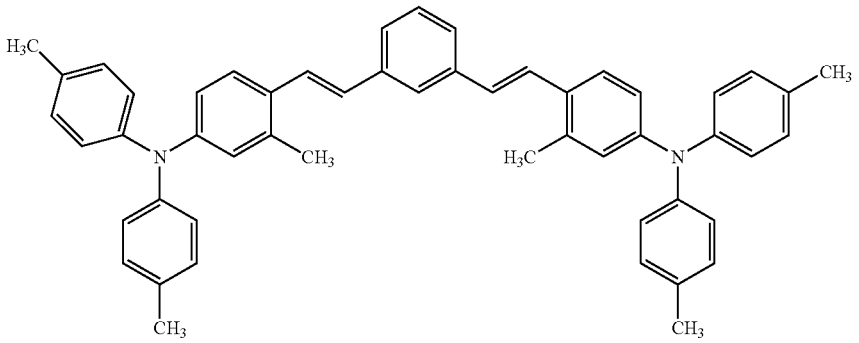

COMPARATIVE EXAMPLE 1

2 parts of a Y-type titanyl phthalocyanine and 1 part of a polyvinyl butyral resin ("LEC BM-1", available from Sekisui Chemical Co., Ltd.) were dispersed with 17 parts of ethanol using a sand mill for 1 hour. The obtained dispersion solution was agitated while adding ethanol dropwise to obtain a coating composition with 4% solids content. This composition was coated on an anodized aluminum drum as in Embodiment 1 using a ring coating method and dried to form a charge generating layer to a thickness of about 0.4 μm.

A charge transporting layer was formed on the charge generating layer in the same manner as in Example 1 to obtain a laminated type electrophotographic photoreceptor. This electrophotographic photoreceptor is basically the same as the electrophotographic photoreceptor disclosed in Japanese Patent Laid-Open Gazette No. 2000-239236.

Figure 4:
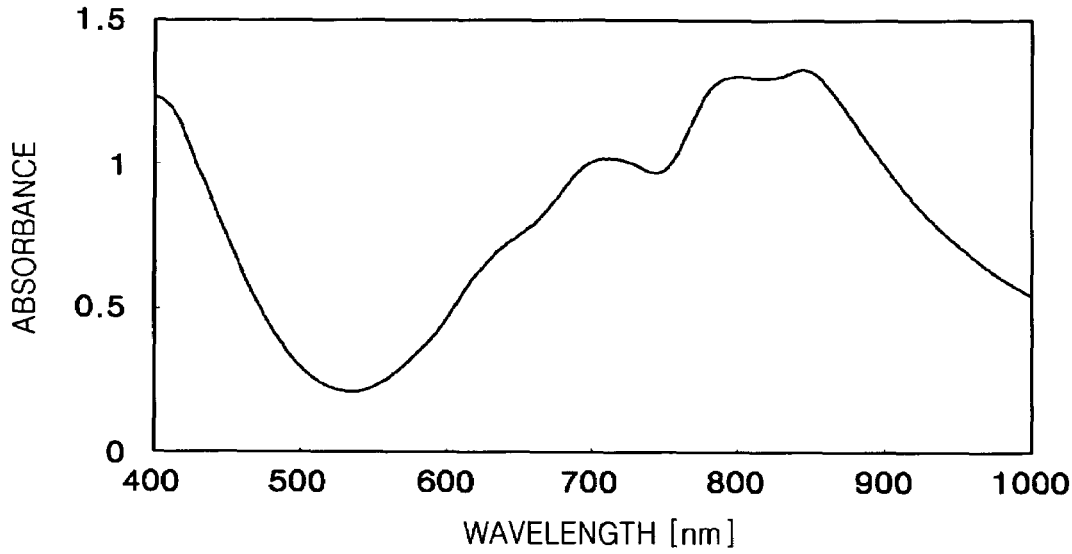
FIG. 4 illustrates a visible-infrared absorption spectrum of a Y-type titanyl phthalocyanine crystal used in Comparative Example 1.
Figure 5:
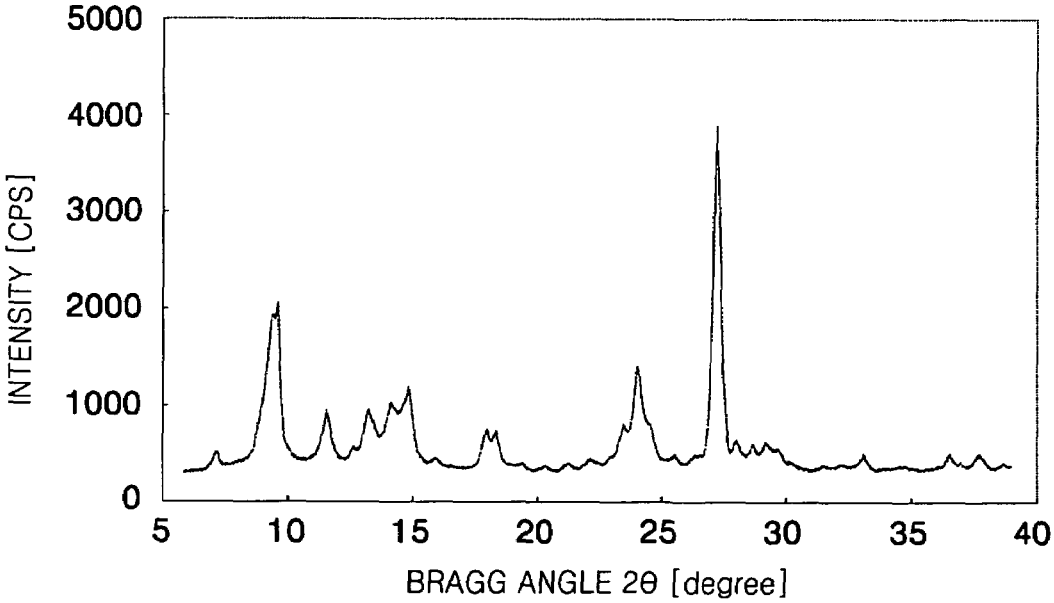
FIG. 5 illustrates an X-ray diffraction spectrum of a Y-type titanyl phthalocyanine crystal used in Comparative Example 1.

FIGS. 4 and 5 respectively show the visible-infrared absorption spectrum and the X-ray diffraction spectrum (using Cu Kα line) of the Y-type titanyl phthalocyanine used in Comparative Example 1.

Comparing the spectra of FIGS. 4 and 5 with the spectra of FIGS. 2 and 3, a remarkable difference can be seen in the visible-infrared absorption pattern and the X-ray diffraction pattern. In other words, when a dispersion composition for a charge generating layer is manufactured using a ball mill in the conventional method without crystal conversion under sufficient stress as in Comparative Example 1, since the stress is not sufficient, it is presumed that the crystal form of the Y-type titanyl phthalocyanine is maintained.

COMPARATIVE EXAMPLE 2

A laminated type electrophotographic photoreceptor was obtained in the same manner as Example 1 except that stilbene Compound 7 below was used instead of the distyryl Compound 1.

Compound 7

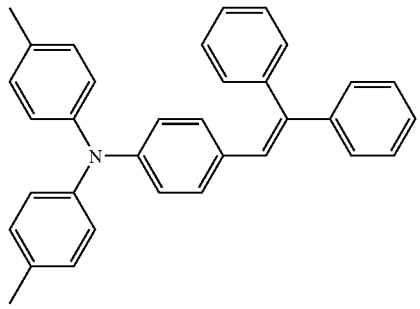

COMPARATIVE EXAMPLE 3

A laminated type electrophotographic photoreceptor was obtained in the same manner as Comparative Example 1 except that the stilbene Compound 7 was used instead of the distyryl Compound 1.

Measurements of Electrophotographic Properties

The electrophotographic properties of each of the photoreceptors obtained in Examples 1 to 3 and Comparative Examples 1 to 3 were measured using a drum type photoreceptor evaluation apparatus (available from QEA, "PDT-2000") at 23° C. and at a humidity of 50% as follows.

Each photoreceptor was charged at a corona voltage of −7.5 kV and at a relative speed of 100 mm/sec of the charging unit and the photoreceptor, and then immediately a monochromatic light having a wavelength of 780 nm in the range of exposure energy of 0 to 5 mJ/$m^2$ was irradiated to the photoreceptor. The surface potential of the photoreceptor after exposure was recorded to measure the relationship between the energy and the surface potential. Here, the surface potential in the case where no light was irradiated was denoted as $V_0$ [V], and the potential after exposure of 5 mJ/m$^2$ was denoted as $V_i$ [V]. Also, exposure energy required for $V_0$ to decay by half is denoted as $E_{1/2}$[mJ/m$^2$].

And, after repeating 200 times the cycle comprised of charging and exposing each photoreceptor under the same condition described above, and then irradiating an erasure light having an exposure energy of 50 mJ/m$^2$ and a wavelength of 660 nm, the electrical properties of the photoreceptors were recorded as described above and variations from the initial states were examined to estimate the repetition stability. The measurement results are shown in Table 1.

TABLE 1

| Photoreceptor | State | $V_0$ (V) | $V_i$ (V) | $E_{1/2}$ (mJ/m$^2$) |
|---|---|---|---|---|
| Example 1 | Initial state | −752 | −28 | 1.02 |
| | After 200 cycles | −750 | −29 | 1.03 |
| Example 2 | Initial state | −748 | −28 | 1.01 |
| | After 200 cycles | −745 | −30 | 1.03 |
| Example 3 | Initial state | −750 | −29 | 1.02 |
| | After 200 cycles | −746 | −31 | 1.04 |
| Comparative Example 1 | Initial state | −748 | −30 | 1.03 |
| | After 200 cycles | −735 | −36 | 1.05 |
| Comparative Example 2 | Initial state | −748 | −36 | 1.05 |
| | After 200 cycles | −753 | −46 | 1.12 |
| Comparative Example 3 | Initial state | −718 | −49 | 1.18 |
| | After 200 cycles | −727 | −60 | 1.23 |

As is evident from Table 1, the photoreceptors of Examples 1 through 3 have smaller residual potential $V_i$ and better $E_{1/2}$ photosensitivity than the photoreceptors of Comparative Examples 1 through 3. Also, after repeating 200 cycles, the residual potential $V_i$ of the photoreceptors of Examples 1 through 3 increases slightly, and the $E_{1/2}$ photosensitivity also is decreased slightly, compared to the photoreceptors of Comparative Examples 1 through 3. Accordingly, it is proven that the photoreceptors of Examples 1 through 3 using the combination of the highly photosensitive titanylphthalocyanine crystal with the new crystal form as a charge generating material and the distyryl compound as a charge transporting material has better photosensitivity and repetition stability than the photoreceptors of Comparative Examples 1 through 3. Particularly, the electrophotographic photoreceptor according to the present invention has a slightly better $E_{1/2}$ photosensitivity than the electrophotographic photoreceptor of Comparative Example 1 according to Japanese Patent Laid-Open Gazette No. 2000-239236; however, since the charge potential $V_i$ after repeating 200 cycles is increased only by a small amount, the stability over repeated charging of the photoreceptor of the present invention is significantly better.

As is evident from the above result, the electrophotographic photoreceptor and the electrophotographic image forming apparatus according to the present invention have good photosensitivity, charging properties and good repetition stability obtained by using an optimum combination of a new crystal type highly photosensitive titanyl phthalocyanine and a distyryl-based charge transporting material having good compatibility with the titanyl phthalocyanine. Accordingly, the electrophotographic image forming apparatus including the electrophotographic photoreceptor according to the present invention can stably produce high quality images.

While the present invention has been particularly shown and described with reference to exemplary embodiments thereof, it will be understood by those of ordinary skill in the art that various changes in form and details may be made therein without departing from the spirit and scope of the present invention as defined by the following claims and equivalents thereof.

What is claimed is:

1. An electrophotographic photoreceptor comprising:

an electrically conductive substrate; and a photosensitive layer formed on the electrically conductive substrate, wherein the photosensitive layer comprises a titanyl phthalocyanine crystal having a major absorption peak at a wavelength of 780 nm±10 nm and a minor absorption peak having an intensity of ¾ or less of the major absorption peak at 690 nm±10 nm in the visible-infrared absorption spectrum and a distyryl compound represented by Formula 1 below:

[Formula 1]

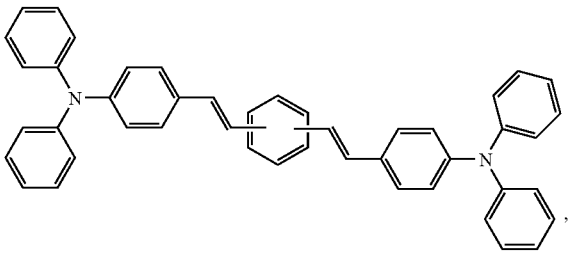

where at least one hydrogen atom of the phenyl and the phenylene group can be substituted with a $C_1$-$C_6$ alkyl group or a $C_1$-$C_6$ alkoxy group, wherein the titanyl phthalocyanine crystal does not have an absorption peak at a wavelength of 800 nm or greater in the visible-infrared absorption spectrum and has a distinct peak at a Bragg angle (2θ) of 9.2°, 14.5°, 18.1°, 24.1°, and 27.3° (all may include an error of ±0.2°) in an X-ray diffraction spectrum.

2. The electrophotographic photoreceptor of claim 1, wherein the photosensitive layer is a single-layered type photosensitive layer having a charge generating function and a charge transporting function at the same time.

3. The electrophotographic photoreceptor of claim 1, wherein the photosensitive layer is a laminated type photosensitive layer comprising a charge generating layer and a charge transporting layer, and the titanyl phthalocyanine crystal is included in the charge generating layer, and the distyryl compound is included in the charge transporting layer.

4. The electrophotographic photoreceptor of claim 1, wherein the titanyl phthalocyanine crystal is obtained by kneading a titanyl phthalocyanine crystal having an absorption peak at a wavelength of 800 nm in a visible-infrared absorption spectrum using an alcoholic solvent.

5. The electrophotographic photoreceptor of claim 4, wherein a polymeric binding resin is present with the titanyl phthalocyanine crystal having an absorption peak at a wavelength of 800 nm in a visible-infrared absorption spectrum and the alcoholic solvent.

6. The electrophotographic photoreceptor of claim 1, wherein the distyryl compound represented by Formula 1 is selected from the group consisting of:

Compound 1

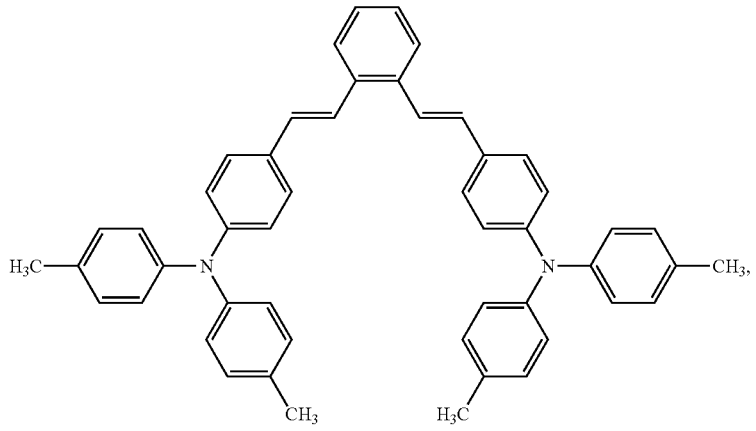

Compound 2

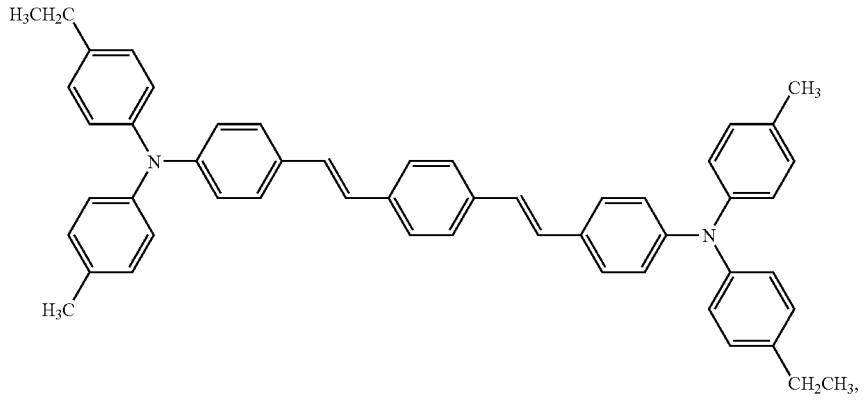

Compound 3

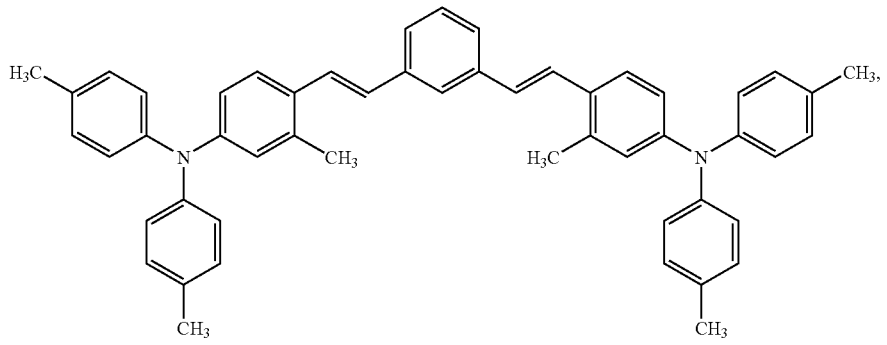

-continued

Compound 4

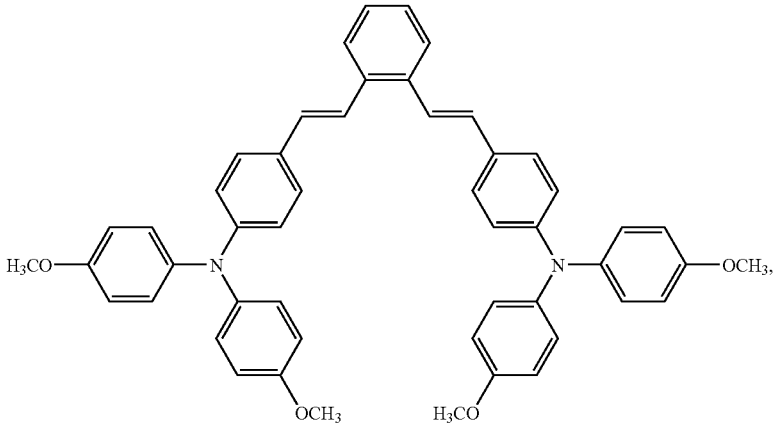

Compound 5

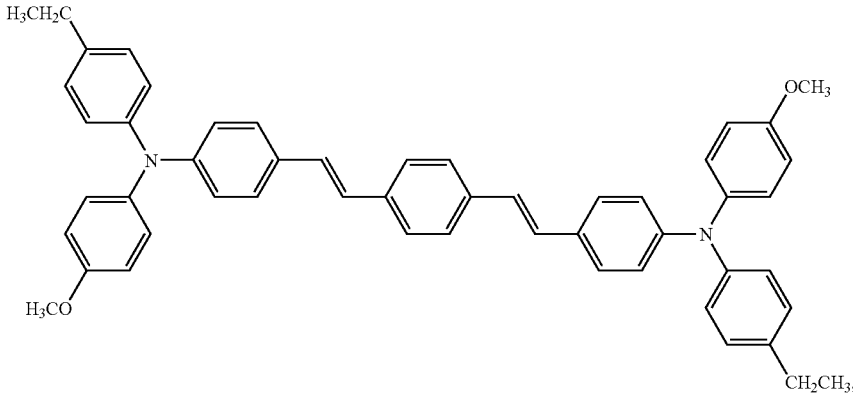

and

Compound 6

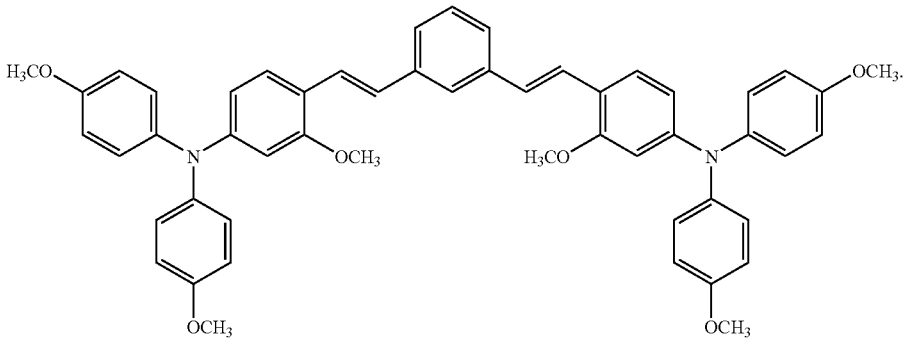

7. An electrophotographic image forming apparatus comprising:

an electrophotographic photoreceptor comprising: an electrically conductive substrate; and a photosensitive layer formed on the electrically conductive substrate, wherein the photosensitive layer comprises a titanyl phthalocyanine crystal having a major absorption peak at a wavelength of 780 nm±10 nm and a minor absorption peak having an intensity of ¾ or less of the major absorption peak at 690 nm±10 nm in the visible-infrared absorption spectrum, and a distyryl compound represented by Formula 1 below:

[Formula 1]

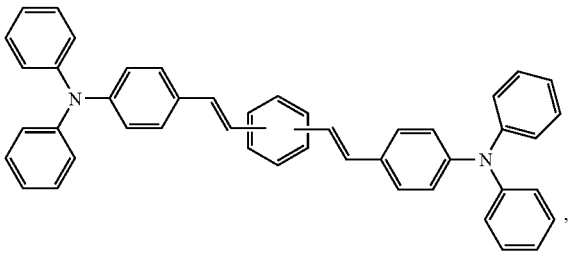

, where at least one hydrogen atom of the phenyl and the phenylene group can be substituted with a $C_1$-$C_6$ alkyl group or a $C_1$-$C_6$ alkoxy group;

a charging apparatus for charging the electrophotographic photoreceptor;

an imagewise light irradiating device for irradiating imagewise light to the charged electrophotographic photoreceptor in order to form an electrostatic latent image on the electrophotographic photoreceptor;

a developing unit for developing the electrostatic latent image with toner in order to form a toner image on the electrophotographic photoreceptor; and a transfer unit for transferring the toner image to an image receptor, wherein the titanyl phthalocyanine crystal does not have an absorption peak at a wavelength of 800 nm or greater in the visible-infrared absorption spectrum and has a distinct peak at a Bragg angle (2θ) of 9.2°, 14.5°, 18.1°, 24.1°, and 27.3° (all may include an error of ±0.2°) in an X-ray diffraction spectrum.

8. The electrophotographic image forming apparatus of claim 7, wherein the photosensitive layer is a single-layered type photosensitive layer having a charge generating function and a charge transporting function at the same time.

9. The electrophotographic image forming apparatus of claim 7, wherein the photosensitive layer is a laminated type photosensitive layer comprising a charge generating layer and a charge transporting layer, and the titanyl phthalocyanine crystal is included in the charge generating layer and the distyryl compound is included in the charge transporting layer.

10. The electrophotographic image forming apparatus of claim 7, wherein the titanyl phthalocyanine crystal is obtained by kneading a titanyl phthalocyanine crystal having an absorption peak at a wavelength of 800 nm in a visible-infrared absorption spectrum using an alcoholic solvent.

11. The electrophotographic image forming apparatus of claim 7, wherein the distyryl compound represented by Formula 1 is selected from the group consisting of:

Compound 1

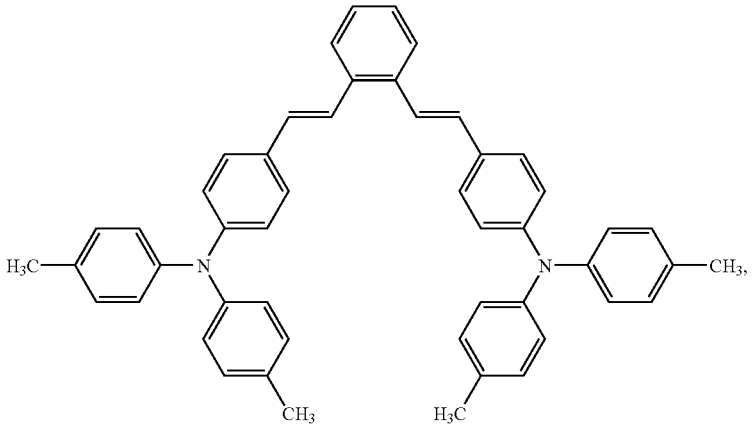

Compound 2

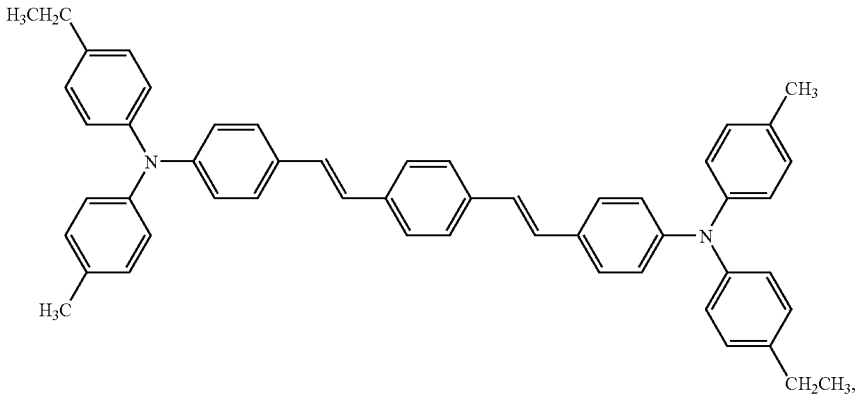

-continued
Compound 3
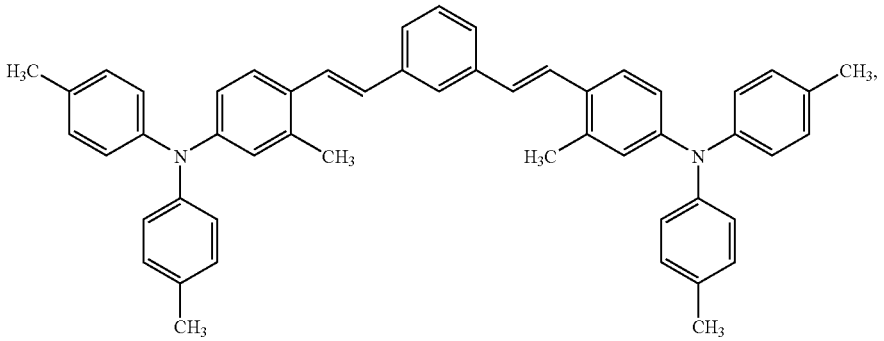
Compound 4
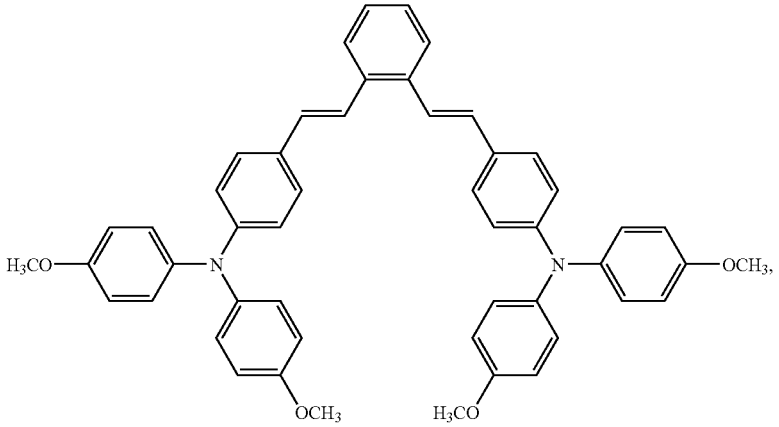
Compound 5
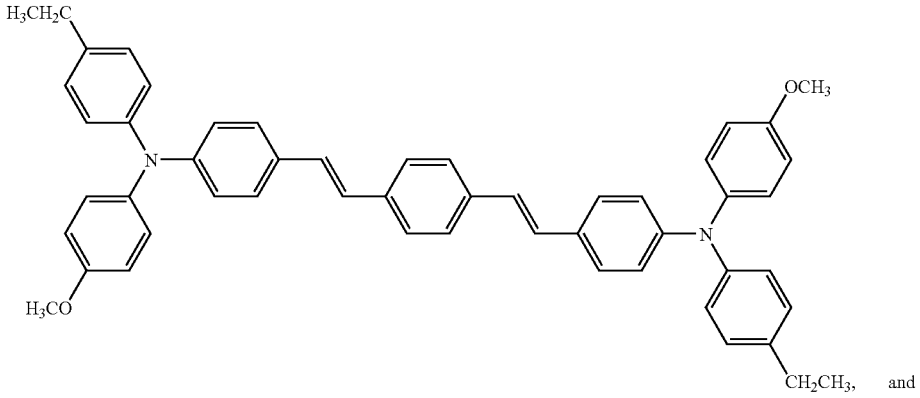
and
Compound 6
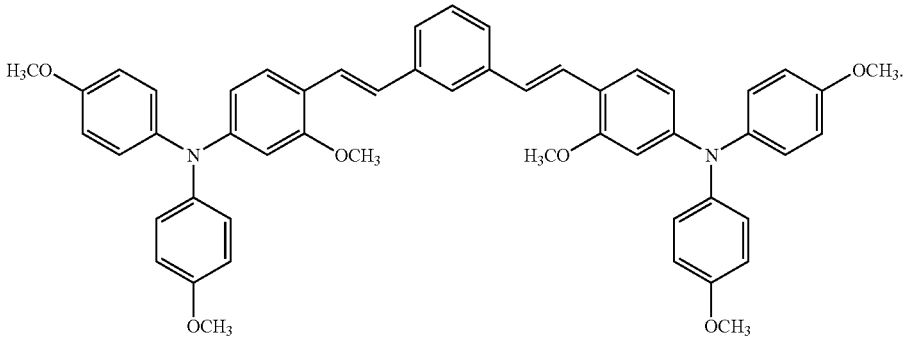
* * * * *